United States Patent [19]

Dykstra

[11] 4,147,100

[45] Apr. 3, 1979

[54] TRASH COMPACTOR

[75] Inventor: Donald P. Dykstra, Des Plaines, Ill.

[73] Assignee: Portable Laboratories, Inc., Elk Grove Village, Ill.

[21] Appl. No.: 913,595

[22] Filed: Jun. 8, 1978

[51] Int. Cl.[2] ..... B30B 15/06; B30B 15/18

[52] U.S. Cl. ..... 100/48; 100/52; 100/53; 100/215; 100/229 A; 100/269 R; 100/295; 100/100

[58] Field of Search ..... 100/295, 100, 53, 229 A, 100/266, 52, 215, 48, 269 R

[56] References Cited

U.S. PATENT DOCUMENTS

| | | | |
|---|---|---|---|
| 594,008 | 11/1897 | Hanak | 100/295 |
| 3,691,944 | 9/1972 | Boyd | 100/229 A |
| 3,831,513 | 8/1974 | Tashman | 100/229 A |
| 3,838,635 | 10/1974 | Hardy | 100/215 |
| 3,901,139 | 8/1975 | Moriconi | 100/229 A |
| 3,905,289 | 9/1975 | Engebretsen | 100/229 A |
| 4,119,027 | 10/1978 | Elders | 100/215 |

*Primary Examiner*—Billy J. Wilhite
*Attorney, Agent, or Firm*—Darbo & Vandenburgh

[57] ABSTRACT

A small portable housing forms a trash compacting chamber in the bottom. At one side of the housing interior, above the chamber, is a space through which trash can fall to the chamber from an upper trash compacting opening. At the other side of the interior of the housing and above the chamber is the compacting mechanism powered by a hydraulic ram. This mechanism includes a carriage supporting a two-part platen, one part of which is below the ram and fixed to the carriage and the other part of which is articulated for movement between a vertical position when raised, and a generally horizontal position across said space when being lowered. Several lost motion mechanisms are disclosed for initially so moving the articulated portion as the ram is extended and thereafter providing carriage movement. A gate is mounted to swing across the space when the platens are lowered so as to catch any trash introduced at that time. A counter is actuated by the opening of a door at the access opening and after a plurality of actuations initiates a compaction cycle. As an alternative to the counter, a timer is employed to cycle the compactor periodically.

17 Claims, 14 Drawing Figures

13
12
11
14
29
10
32
3.
67
149
145
147
78
77
79
80
74
75
76
66
62
128
63
81
71
65
64
113
112
68
45
44
84
85
34
110, 111
146
148
36
35
54
69
50
51
53
37
70
48
47
49
30
31
25
24
23
26
27

TRASH COMPACTOR

BACKGROUND AND SUMMARY OF THE INVENTION

The present invention relates to a relatively small trash compactor, i.e., one that produces a bale of compacted trash which is sufficiently small to be manually transportable. Such small trash compactors are commonly used in households. It has been suggested by others that under certain circumstances such compactors might be particularly desirable in a fast food service outlet, airports, amusement parks, convention centers, etc., in place of the rubbish collecting containers commonly used at a number of locations in such places.

The small compactors generally commercially available at the present time generally employ something in the nature of a drawer which is opened to receive the trash and within which the trash is compacted when the drawer is closed. While these are acceptable for household use, they would not be particularly desirable for use in food outlets, etc., because of unsightliness of the drawer and its contents when open, the necessity for manipulation of the drawer, etc. For use in a food outlet, etc., a compactor must resemble the trash bins now being used in that there is a cabinet having an opening in an upper part into which the trash can be inserted and having compaction mechanism in that cabinet to compact the trash inserted through that access opening. The principal object of the present invention is to provide an effective small trash compactor having such a configuration and thus being suitable for use in food outlets, etc., or the like. At the same time, the compactor of the present invention is not limited to such a use since it would also be quite usable in a home, etc.

Others have proposed achieving this objective by having a compacting chamber in the lower part of the cabinet, or housing, and a space at one side of the cabinet, and above the compacting chamber, through which the trash can descend from the access opening to the chamber. The compaction mechanism would be in juxtaposition to that space and arranged so that it does not obstruct the free fall of trash from the access opening to the compaction chamber. Such arrangement conserves space within the cabinet and thus maintains the size of the cabinet to a minimum. The compaction mechanism would have a platen portion which was intended to swing from a generally upright position to a generally horizontal position transverse to that space during the compaction cycle so that the trash in that chamber and below that space will be compacted. The trash in the remaining portion of the chamber would be compacted by a second platen portion which only moves vertically. In actual practice this device proposed by others was not effective since the movable platen portion was not effective to clear accumulated trash from the space leading from the housing opening to the compaction chamber and to compact trash in that portion of the chamber my invention overcomes this problem by initially, in the compaction cycle, moving the movable platen through said space to a generally horizontal position and thereafter commence lowering the carriage to carry out the actual compaction. Thus I provide a lost motion connection between a hydraulic ram and the carriage as well as a connection between the ram and the movable platen portion, so that upon the extension of the ram, the movable platen portion is first actuated and thereafter the carriage is moved.

Another feature of my invention is the use of a gate to block off the trash receiving space during a compaction cycle. This gate is arranged so as to catch any trash inserted into the cabinet during a compaction cycle and hold that trash out of the way of the compaction mechanism until the compaction cycle is completed. Upon the completion of the compaction cycle the gate opens to permit the trash being so held to fall into the compaction chamber.

Another feature of the invention is an arrangement for initiating a compaction cycle which does not depend upon an individual pushing a button or the like as in the usual small compactor. Thus the compaction of the trash, when required, does not depend upon the fast food store relying upon a patron, or an employee, taking such a button pushing action when compaction is required. Obviously, such a procedure would be quite unreliable and would undoubtedly merely result in the housing filling up with uncompacted trash which would ultimately spill out the access opening. It also is an invitation to children or irresponsible individuals to play with the mechanism. In the present invention there is a door on the access opening (much like the door on the usual trash bin used in such establishments) and after the door has been opened a predetermined number of times a trash compaction cycle is initiated. Thus the door counts the number of trays, etc., of trash that customers have inserted into the compactor and upon the count reaching a number (determined empirically) corresponding to a reasonable amount of trash requiring compaction, the compaction cycle occurs. Alternatively, a timer can be employed to cycle the compaction mechanism periodically.

Other objects and advantages of the invention will be apparent from the following description taken in conjunction with the drawings.

DESCRIPTION OF THE DRAWINGS

FIG. 14 is a diagrammatic illustration of the control apparatus.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

EMBODIMENT OF FIGS. 1-7 AND 14

Figure 1:
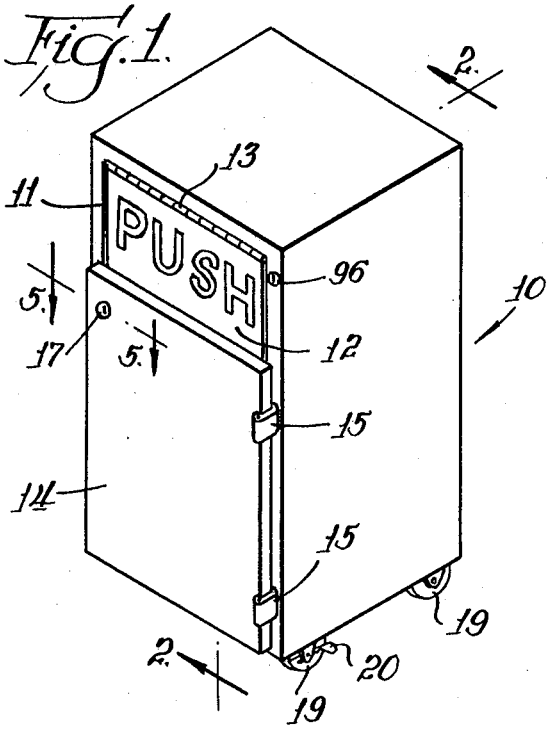
FIG. 1 is an isometric view of the exterior of a compactor in accordance with the present invention.

Referring to FIG. 1, the compactor is in a housing or cabinet, generally 10. At the upper part of the front of the cabinet is an access opening 11. A door 12 is suspended across this opening by a piano hinge 13. Thus the weight of the door holds it in the closed position, but it may be pushed inwardly to permit trash to be inserted into the housing. The lower part of the front of the housing also is open (a continuation of opening 11) and is closed by a door 14. Door 14 is supported by hinges 15 so that it may be opened to remove the compacted trash. Door 14 is sufficiently high to prevent door 12 from swinging outwardly.

Figure 5:
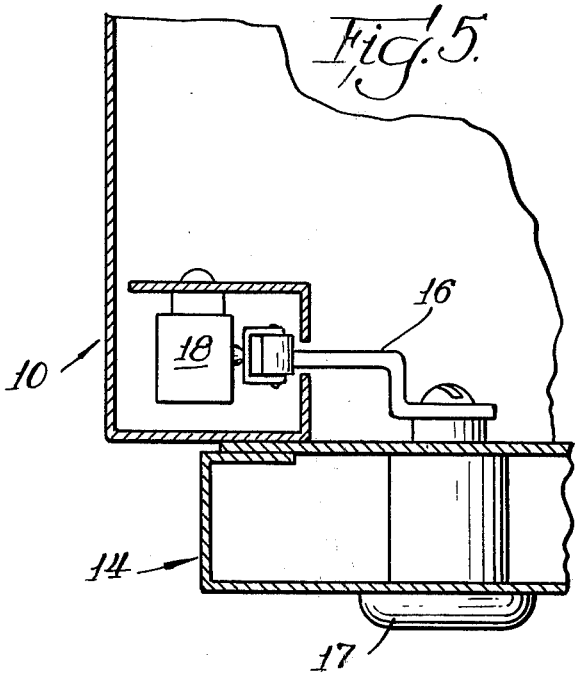
FIG. 5 is a fragmentary section as seen at line 5—5 of FIG. 1.
Figure 4:
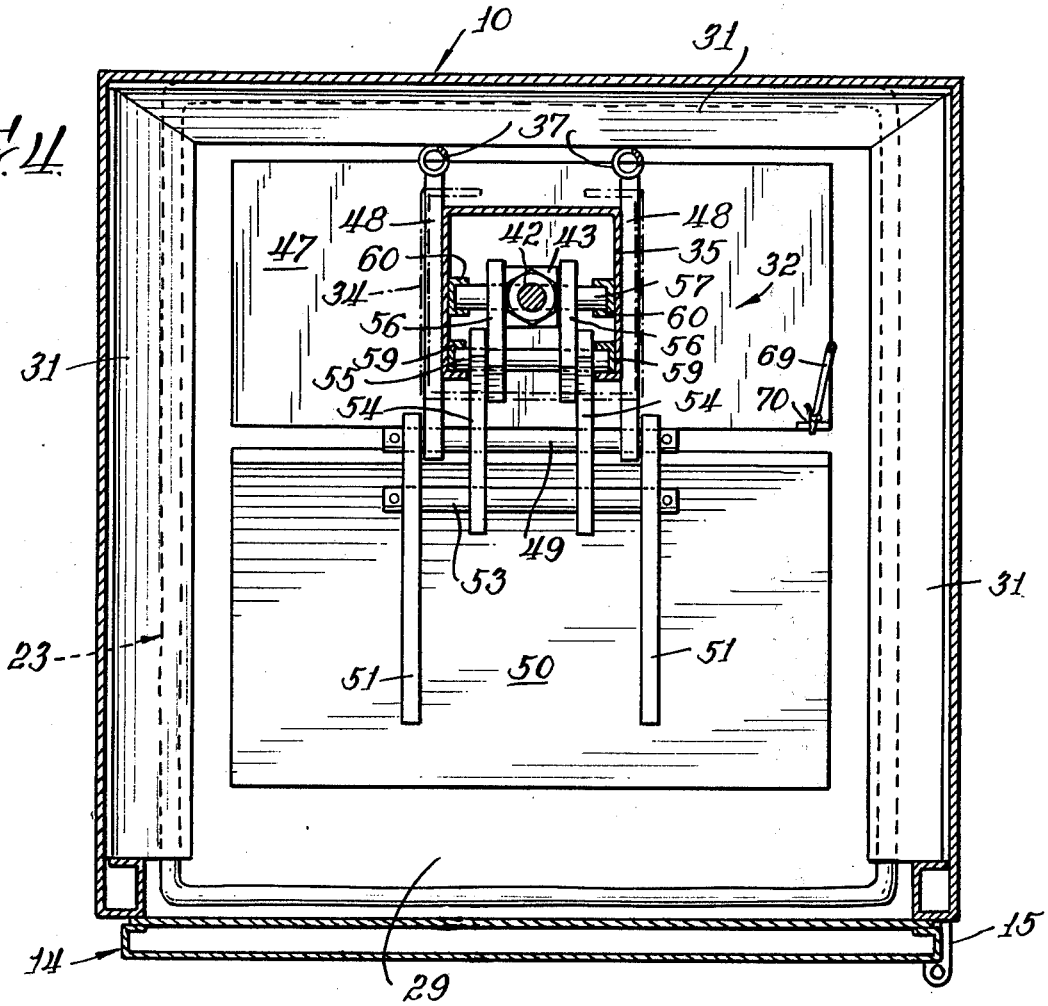
FIG. 4 is a section as seen at line 4—4 of FIG. 3 during the compaction cycle with the movable portion of the platen in substantially a horizontal position.

Door 14 is held closed by an arm 16 held by a lock 17 (FIG. 5). With the use of an appropriate key in lock 17, arm 16 may be rotated ninety degrees to a position at which the door may be opened. When in the locked position, arm 16 also actuates a snap-action electrical switch 18. As hereinafter described, switch 18 is used as an interlock to prevent the compactor from being unintentionally operated except when the door is closed and locked. A lock 96 includes an electrical switch and is operated to cycle the compaction mechanism if desired. The cabinet is mounted on wheels or casters 19 for portability. At least one of these wheels or casters includes a lock 20 which may be operated to immobilize the respective wheel and thus the compactor cabinet.

Figure 2:
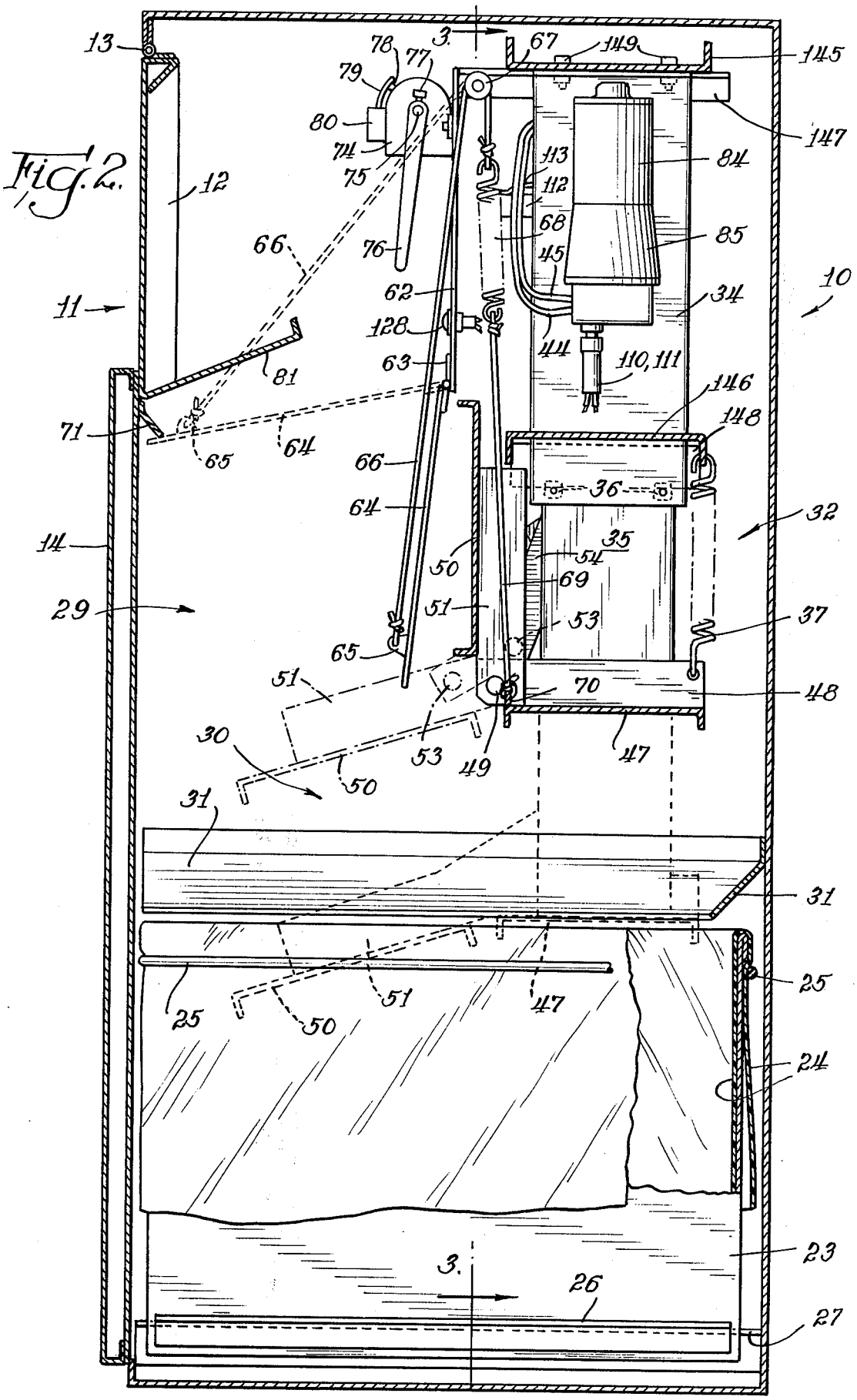
FIG. 2 is a section as seen at line 2—2 of FIG. 1.
Figure 3:
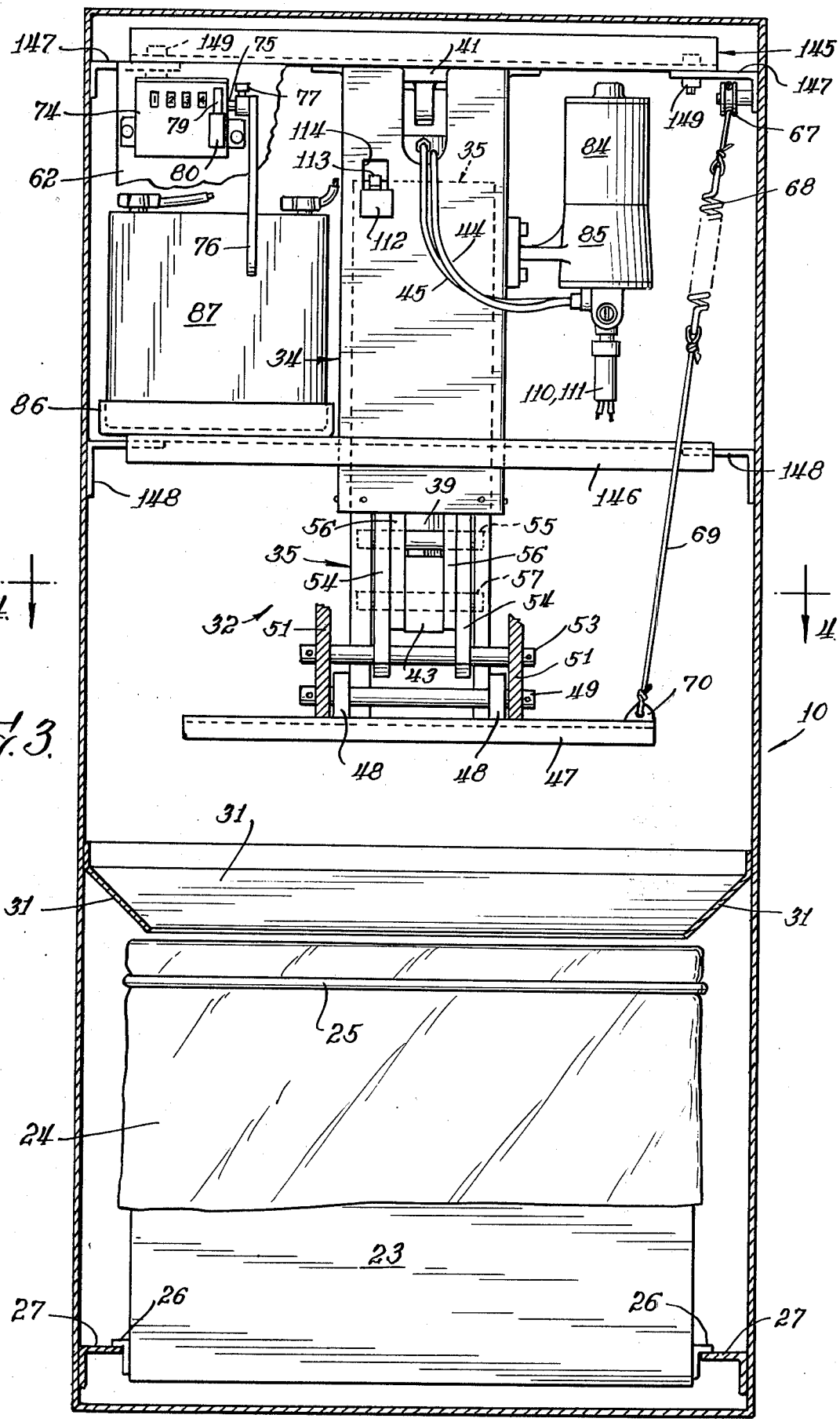
FIG. 3 is a section as seen at line 3—3 of FIG. 2.

At the interior thereof, cabinet 10 includes various frame portions, subsequently described. It also includes a removable container 23 (FIGS. 2, 3). Container 23 defines that part of the compaction chamber in which the compaction actually occurs. A plastic or paper bag 24 may be inserted into the container, with the top of the bag draped over the outside of the container. An elastic, e.g., rubber, band 25 is placed about this draped portion of the bag to immobilize it. The container has wings 26 which rest on angle supports 27 affixed to the cabinet walls and forming a part of the frame.

Along the front side of the interior of the cabinet is a space 29 (FIG. 2) which extends from the access opening 11 to the lower part of the housing, which lower part may be referred to as the compaction chamber 30. It is through this space 29 that the rubbish, inserted through opening 11, falls into the compaction chamber. The frame includes deflectors 31 to ensure that such trash does not fall down outside the container 23, between it and the housing. In the rear of the housing, in juxtaposition to space 29, is the compaction mechanism, generally 32.

The frame includes a tubular portion 34, generally rectangular in cross section, which defines a vertical way. A support means for the platens includes a carriage 35 vertically movable in this way. Buttons 36 of a low friction plastic material (e.g., Teflon) are mounted both on the tubular portion and on the carriage to provide contact with the other respectively. A spring 37 interconnecting the tubular portion and carriage is sufficiently strong to normally hold the carriage in the raised position.

The platen support means includes power means for performing the compaction operation which comprises a hydraulic ram 39. At its upper end the housing of the ram is pivotally connected by a pin 40 to a support 41 forming a part of the frame. A piston rod 42 extends from the lower end of the ram and is secured to a block 43. The ram is double acting and has connections at each end of the cylinder for hydraulic fluid conduits 44 and 45, respectively.

A fixed platen member 47 is secured to the bottom end of the carriage 35 in an approximately horizontal position. A pair of bars 48 are secured to this platen and to the carriage. These bars hold a pin 49. A movable or articulated platen member 50 has a pair of arms 51 which are journaled on pin 49. A second pin 53 also extends between arms 51. Two links 54 are journaled at one end thereof on pin 53. At the other end thereof the links 54 are journaled on a pin 55. Also journaled on pin 55 are a pair of links 56. Links 56 are also journaled on a pin 57 which extends through block 43.

Secured in the bottom of carriage 35 are a first pair of tracks 59 and, adjacent thereto, a second pair of tracks 60. Pin 55 extends into tracks 59 and forms a traveler. Likewise, pin 57 extends into tracks 60 and forms a traveler. Tracks 59 and 60 are parallel. As seen in the drawings, they appear to be vertical although actually they have a very slight inclination, with the bottom thereof being a slight amount to the left, as viewed in FIGS. 6 and 7, of the top thereof.

The frame includes a fixed plate 62 (FIGS. 2, 3) positioned rearwardly of access opening 11 and at the opposite side of space 29 from that opening. A hinge 63 is secured to the bottom end of this plate and to the top of a movable plate 64 which forms a gate. Adjacent the bottom end of the gate is an eye 65. A cord 66 is connected to this eye, extends about a pulley 67 and is connected to a spring 68. The other end of the spring is connected by a cord 69 to an eye 70 on platen 47. As hereinafter explained, the gate 64 is raised while a compacting cycle is taking place. In the raised position the gate is against the bottom of a deflector 71 of the frame, thus forming a barrier transverse to the space 29 through which the rubbish normally descends.

Also mounted on plate 62 is a mechanical counter 74. Except as hereinafter described, this counter is a conventional mechanical counter of a type such that a few degrees of counterclockwise (as viewed in FIG. 2) rotation of the input shaft 75 thereof will register a count of one in the counter. An internal spring, not shown, returns the shaft to its original position when this counterclockwise rotational force is released. Such counters are a conventional, over-the-counter item. An arm 76 is secured to the input shaft by a set screw 77. The units dial (0-9) of the counter is provided with a projection 78 (FIG. 2). The actuating arm 79 of a snap-action electrical switch 80 is positioned to be actuated by projection 78 each time that the projection comes around at the completion of one rotation of the units dial, thus each time that the input shaft of the counter has been actuated ten times. Provision is made to permit the projection 78 to be removed and replaced on another of the counter dials (e.g., the tens dial) or additional projections inserted onto the units dial, whereby the number of counts occurring before switch 80 is actuated may be varied. At the bottom of door 12, and in alignment with counter arm 76 is a projection 81. The arrangement is such that when door 12 is fully opened it moves arm 76 counterclockwise to register a count in the counter 74.

Mounted on the side of the tubular portion 34 of the frame is a unit comprising an electric motor 84 coupled to a hydraulic pump 85. In the illustrated embodiment motor 84 is a reversible, 12-volt, direct current motor. Hydraulic lines 44 and 45 from the ram are connected to the pump 85. The arrangement is such that the pump merely pumps the hydraulic fluid from one end of the ram to the other, the direction of pumping being controlled by the direction of rotation of the motor. Thus the motor is energized for rotation in one direction to lengthen the ram and thus lower the carriage 35, and energized for rotation in the opposite direction to shorten the ram and thus raise the carriage. The frame includes a battery support 86. A 12-volt, wet (e.g. lead-acid) battery 87 is held in this support.

Referring to FIG. 14, the electrical controls include a fuse 90 connected to battery 87, the other side of the battery being grounded. A wire 91 connects the fuse to safety switch 18 and to a battery charge indicator, generally 92. A wire 93 connects switch 18 to switches 80 and 96 and also to a switch 94 operated by a timer 95. As previously mentioned, switch 96 is a key operated switch located on the front of the cabinet. A pair of switches 97 and 98 are interconnected so that one is open when the other is closed and vice versa. Wire 99 connects switches 94 and 97 and wire 100 connects switches 80 and 98.

Figure 6:
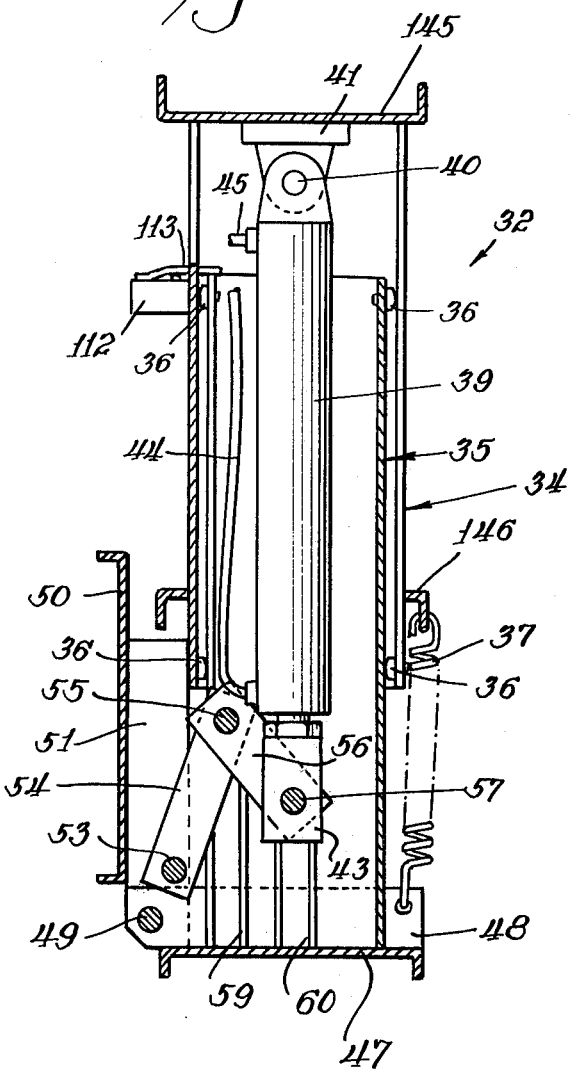
FIG. 6 is a fragmentary sectional view of the compaction mechanism showing one embodiment of the means for operating the movable portion of the platen and showing that movable portion in the raised position.

Three relays are employed, namely: a main relay comprising solenoid 102, a normally closed switch 103, and two normally open switches 104 and 105; an "up" power relay comprising solenoid 106 and normally open switch 107; and a "down" power relay comprising solenoid 108 and normally open switch 109. A pressure sensor 110 is connected to communicate with hydraulic conduit 45 so as to measure the pressure therein. When the pressure sensor detects pressure of a given maximum magnitude it opens electrical switch 111. Switch 112 is a normally closed limit switch and, as seen in FIGS. 3 and 6, is mounted on the tubular frame portion 34 so that the switch actuating arm 113 is moved when the carriage reaches its upper position to thereby open the switch 112. For this purpose there is an opening 114 in the frame portion 34 to permit the switch arm to extend within that frame part so as to be contacted by the carriage as the carriage reaches the limit of its upward movement.

A wire 117 connects switches 96, 97, 98, 104, 105 and 111. Wire 93 also connects to switches 103, 105, 107 and 109. Wire 118 connects solenoid 106 and switch 112. Wire 119 connects switches 103 and 112. Wire 120 connects switch 104 to solenoid 108. Wire 121 connects solenoid 102 to switch 111. Wires 122 and 123 connect motor 84 to switches 107 and 109 respectively.

The battery charge indicator 92 is arranged to activate light emitting diode (LED) 128 when the charge of battery 87 has been reduced to a given extent, e.g., half charge. As best seen in FIG. 2, the LED is mounted on panel 62 where it can be viewed when door 14 is open. The control circuit for energizing the LED is basically an operational amplifier wired to function as a comparator-amplifier. It includes an amplifier 129, e.g., an I.C. type 741. Wire 91 connects to the power supply connection for the amplifier, to a potentiometer 130 and to a resistor 131. A wire 132 connects potentiometer 130 to a resistor 133. A wire 134 connects resistor 131 to Zener diode 135 and to the inverting input of amplifier 129. A wire 136 connects resistor 133 to a resistor 137 and to the non-inverting input of amplifier 129. A wire 127 connects to ground, to Zener diode 135 and to resistor 137. The output of amplifier 129 is connected by a wire 138 to a resistor 139 which in turn is connected by a wire 140 to LED 128. As indicated by wire 141, both the amplifier 129 and the LED are connected to ground. As a typical example of components, potentiometer 130 is 1K ohms, resistor 131 is 2.2K ohms, resistor 133 is 3.3K ohms, resistor 137 is 3.9K ohms and resistor 139 is 100 ohms. Zener diode 135 is a 1N4735.

Potentiometer 130 is adjusted to cause the LED 125 to emit light at a given degree of discharge of battery 87. At that time a charger, not shown, is connected to battery 87 to charge the battery. In some embodiments this charger will be incorporated into the housing 10 and connected to battery 87, with the charger being plugged into a wall outlet at such times as it is desired to charge the battery. In a fast food store, for example, the charger may be plugged in every night when the store is closed to recharge the battery for the next day's operation.

One feature of the invention is that the compactor components all are mounted on a subframe comprising upper channel 145, lower channel 146 and the tubular frame portion 34, which subframe and components are an integral unit. The upper channel rests on angles 147 and the lower channel rests on angles 148. These channels are permanently affixed to the housing. Bolts 149 releasably affix the upper channel to the upper angles 147. Thus by opening the doors and removing bolts 149, this subframe may be removed when servicing or replacement of the compactor mechanism is required.

Operation

With the compactor mechanism in the position illustrated in FIG. 2 (and with the controls as illustrated in FIG. 14) rubbish may be inserted into the compactor by opening door 11 and dropping the rubbish through space 29 into the compactor chamber, primarily defined by the interior of container 23. The plate 62 and gate 64 serve as a rear wall of a chute about space 29. As previously explained, each time that this is done the projection 81 on the rear of door 12 holds the arm 76 on the counter to introduce a count into the counter 74. After a predetermined number of counts (e.g., 10) switch 80 is closed. Alternatively, switch 96 may be closed with a key to initiate a compaction cycle. Also, as subsequently explained, timer 95 may be used to close switch 94 to initiate compaction cycles.

When a cycle initiating switch is closed, the solenoid 102 of the main relay is energized through wire 117, switch 111 and wire 121. The energizing of the solenoid opens switch 103 and closes switches 104 and 105. The closing of switch 105 acts as a holding circuit, since that switch is in parallel with switches 94, 96, 80; thus the latter switches may open without deenergizing solenoid 102. Through wire 120 the closing of switch 104 energizes solenoid 108 of the "down" relay resulting in the closing of switch 109 thereof. The closing of switch 109 energizes motor 84 through wire 123. This rotates the pump 85 in a direction such that the hydraulic fluid is pumped out of the ram 39 through conduit 44 and returned to the ram through conduit 45. This causes the piston rod 42 to move out of the ram thus commencing the compacting operation.

Figure 7:
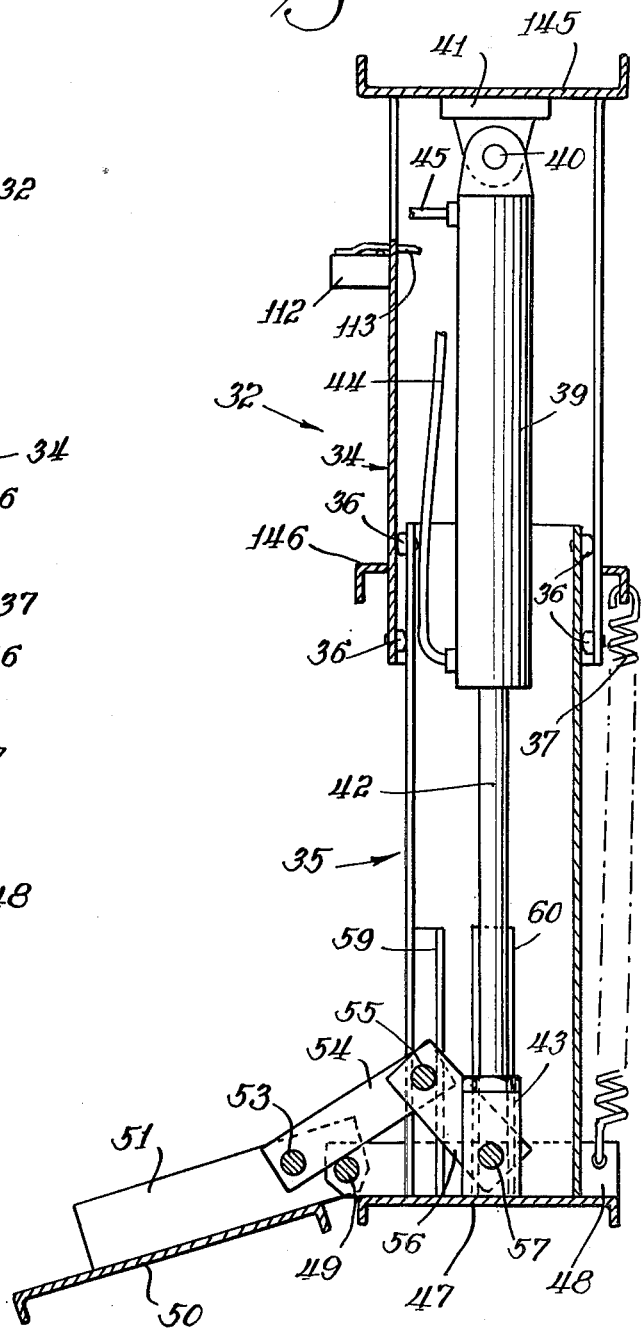
FIG. 7 is a view corresponding to FIG. 6 but showing the positions of the portions of the platen during compaction.

Referring particularly to FIGS. 6 and 7, the initial extension of the piston rod 42 causes block 43 and traveler to move downwardly with respect to the carriage. As it does so link 56 pulls down on link 54. This causes link 54 to rotate the movable platen 50 about pin 49. FIG. 6 illustrates the position of parts before this action occurs and FIG. 7 illustrates the position of the parts upon the completion of the rotation of the movable platen 50, i.e., the pressing or compacting position of the movable platen 50. If the gate 64 has not yet moved away from the position illustrated in FIG. 2, the movable platen will push against the gate and cause it to commence a clockwise rotation toward the dotted line position illustrated in FIG. 2.

After the downward force exerted by the ram on the carriage exceeds the resistance of spring 37 (which will be about when the block 43 bottoms against fixed platen 47), the carriage commences its downward movement. The movement of the blocks in the track provides a lost motion connection between the ram and the carriage which permits the ram to extend some distance (during which the movable platen 50 is pivoted) and thereafter the ram becomes effective to move the carriage. As it does so it pulls on cord 69, spring 68 and cord 66 and the continued downward movement of the carriage draws the gate 64 to the position illustrated in dotted lines in FIG. 2. This position of the gate will occur before the carriage moves very far downwardly. However, the subsequent pull on cord 69 resulting from the continued downward movement of the carriage will merely serve to expand spring 68. With gate 64 in the position illustrated in dotted lines in FIG. 2, it is still possible to insert trash through opening 11 after door 12 is opened. However, because of the position of the gate 64, that trash is not permitted to descend through space 29 into the compacting chamber.

The downward movement of platens 47, 50 causes a compaction of the trash in the compacting chamber. Also, the movement of the movable platen 50, as above described, and its final angular position, as illustrated in FIG. 7, result in trash from the front side of the compactor (i.e., below space 29) being forced toward the rear of the compactor (i.e., below fixed platen 47).

Of course, as the compaction occurs the trash exerts a resistance to the continued extension of piston rod 42 and this resistance is reflected as a build-up in hydraulic pressure in conduit 45. A suitable stop (not shown) is provided between the carriage and the frame to limit the maximum extent of downward movement of the carriage. Thus should the compactor be cycled when the compaction chamber is empty, the action of the carriage in reaching that stop will similarly cause a build-up in the pressure in conduit 45.

When the pressure in conduit 45 reaches the magnitude established by the setting of pressure sensor 110, that sensor opens switch 111. This breaks the circuit to the main relay solenoid 102 and the deenergizing of the solenoid causes switches 103, 104, 105 to return to the position illustrated in FIG. 14. Consequently, solenoid 108 of the "down" relay also is deenergized and switch 109 opens to deenergize motor 84.

At the commencement of the downward movement of the carriage, switch 112 will have closed. Thus through wires 119, 118 the closing of switch 103 energizes solenoid 106 of the "up" relay to close switch 107 thereof. Switch 107 energizes motor 84, through wire 122, for rotation in the opposite direction whereupon hydraulic fluid is pumped out of the ram 39 through conduit 45 and returned to the ram through conduit 44. This causes the piston rod 42 to be retracted, initially retracting platen 50 to the FIG. 6 position and then raising carriage 35. When the carriage reaches the full-up position it engages switch arm 113 to open switch 112. This deenergizes the "up" relay solenoid 106 to open switch 107. The motor 84 stops and the compacting cycle is completed.

Under some circumstances, it may not be desired to use a door actuated counter as a means for initiating the compacting cycle. For example, at times children might start playing with the door to cause an undesirable repetitive cycling of the compactor. Thus there is provision for using a timer 95 to periodically cycle the compactor. To do this, the positions of switches 97, 98 are changed. The opening of switch 98 prevents the counter 74 from initiating the compacting cycle. The closing of switch 97 enables timer 95 to periodically close and then open switch 94 and with each closing of that switch a compacting cycle is initiated. The timer 95 need not be described in detail. Preferably it would comprise an integrated circuit oscillator or multi-vibrator having a fixed frequency of oscillation. Frequency dividers would be employed to arrive at a period, e.g., three minutes, at the end of which period a pulse would be produced to activate a mechanical relay, an SCR or the like. Thus a switch, mechanical or electronic, would be closed to perform the function of the switch 94 illustrated in FIG. 14. Other forms of known timing devices could be employed.

ACTUATING EMBODIMENT OF FIGS. 8 AND 9

Figure 8:
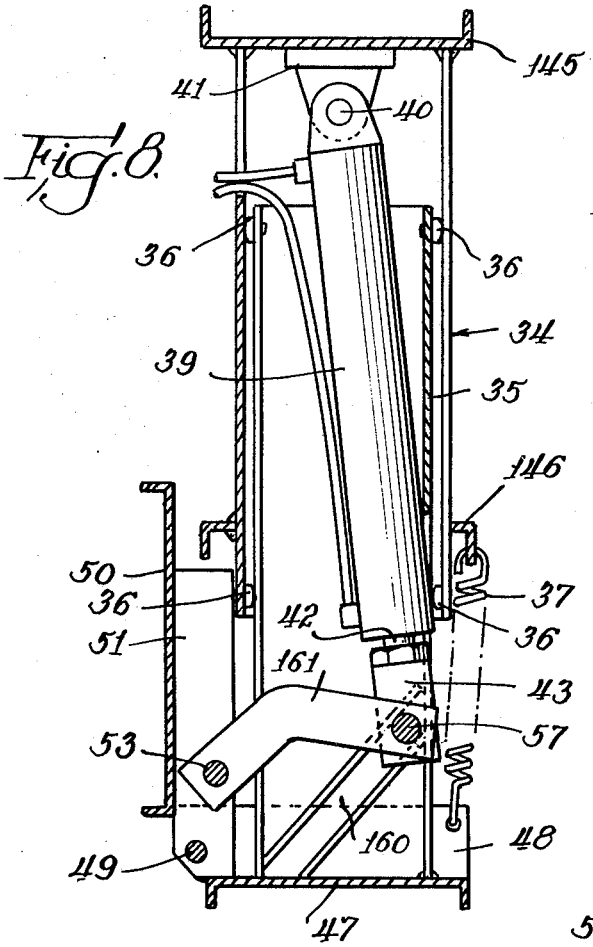
FIG. 8 is a view corresponding to FIG. 6, but showing another embodiment of the mechanism for operating the movable platen.
Figure 9:
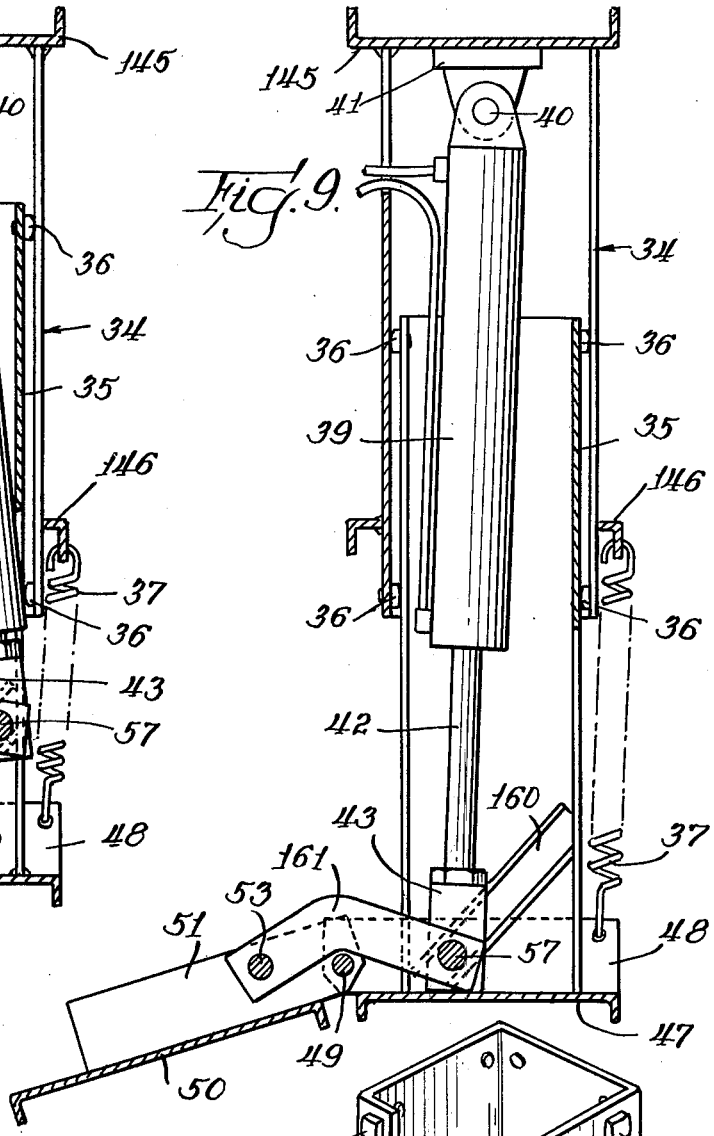
FIG. 9 is a view corresponding to FIG. 7 but showing the mechanism of FIG. 8.
Figure 10:
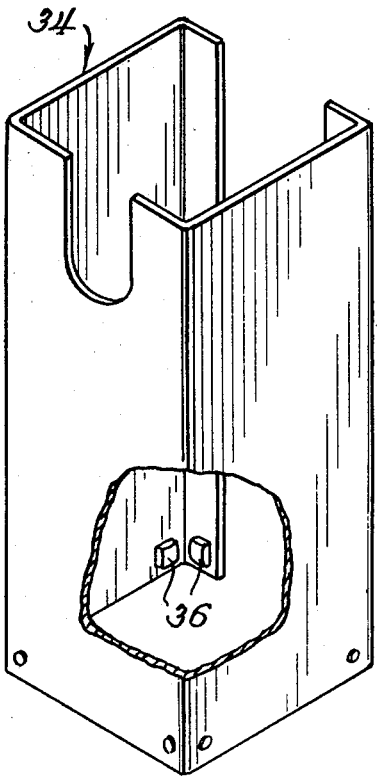
FIG. 10 is an isometric view, with a portion broken away, of that portion of the frame forming a way for the carriage of the compaction mechanism.
Figure 11:
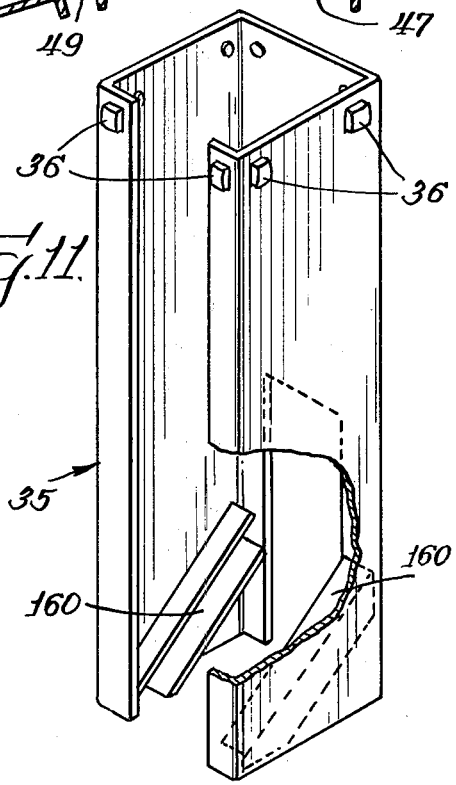
FIG. 11 is an isometric view of the carriage of the compaction mechanism used with the way of FIG. 10 and with a portion broken away to show the guide employed in the embodiment of FIGS. 8 and 9.

FIGS. 8 and 9 illustrate an alternative construction for the operation of the movable platen 50. In this embodiment the carriage 35 is identical to that previously described, except that there is but a single pair of tracks 160 affixed to opposite sides of the carriage adjacent the bottom thereof. Pin 57 is received in those tracks and serves as a traveler therein. A pair of single links 161 are employed at opposite sides of block 43. Links 161 are pivotally mounted on pins 53 and 57. It will be noted that tracks 160 have a substantial inclination with the bottom thereof in a vertical plane substantially closer to the pivotal shaft 49 than is a vertical plane through the top of the tracks.

FIG. 8 illustrates the relative position of the parts when the carriage is in the raised position. As piston rod 42 moves outwardly from the ram it forces the traveler 57 downwardly and the tracks 160 cam the traveler to the left as viewed in FIG. 8. The ends of the links 161 that are journaled on pin 57 perform a corresponding movement. Thus the links 161 are moved to the left in FIG. 1 causing a rotation of the movable platen 50 to the position illustrated in FIG. 9. A reverse movement of the links and platen 50 will occur upon the raising of the piston rod. This will occur before the carriage reaches its uppermost position.

Figure 12:
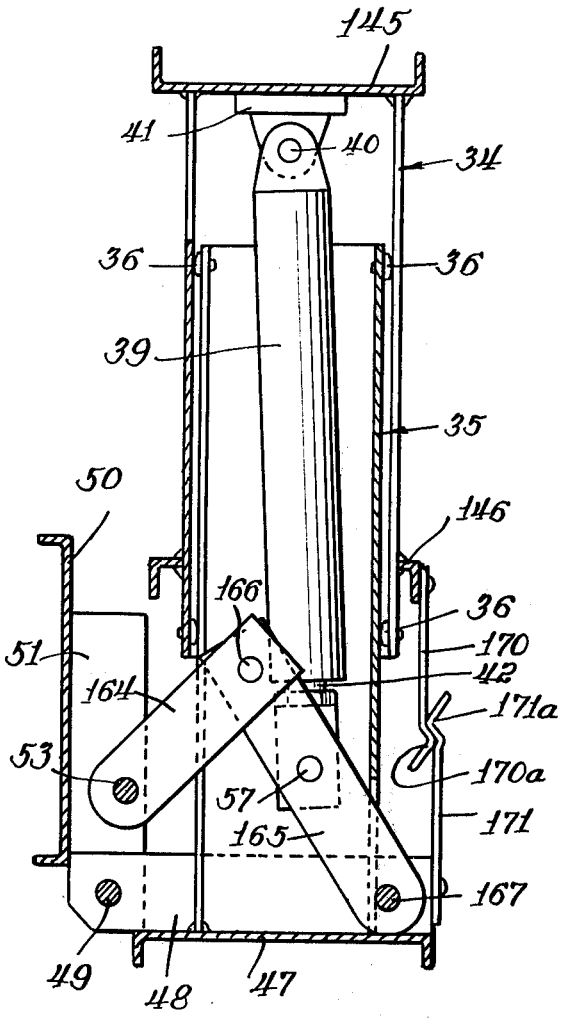
FIG. 12 is a view corresponding to FIG. 6 but showing still another form of mechanism for operating the movable platen.
Figure 13:
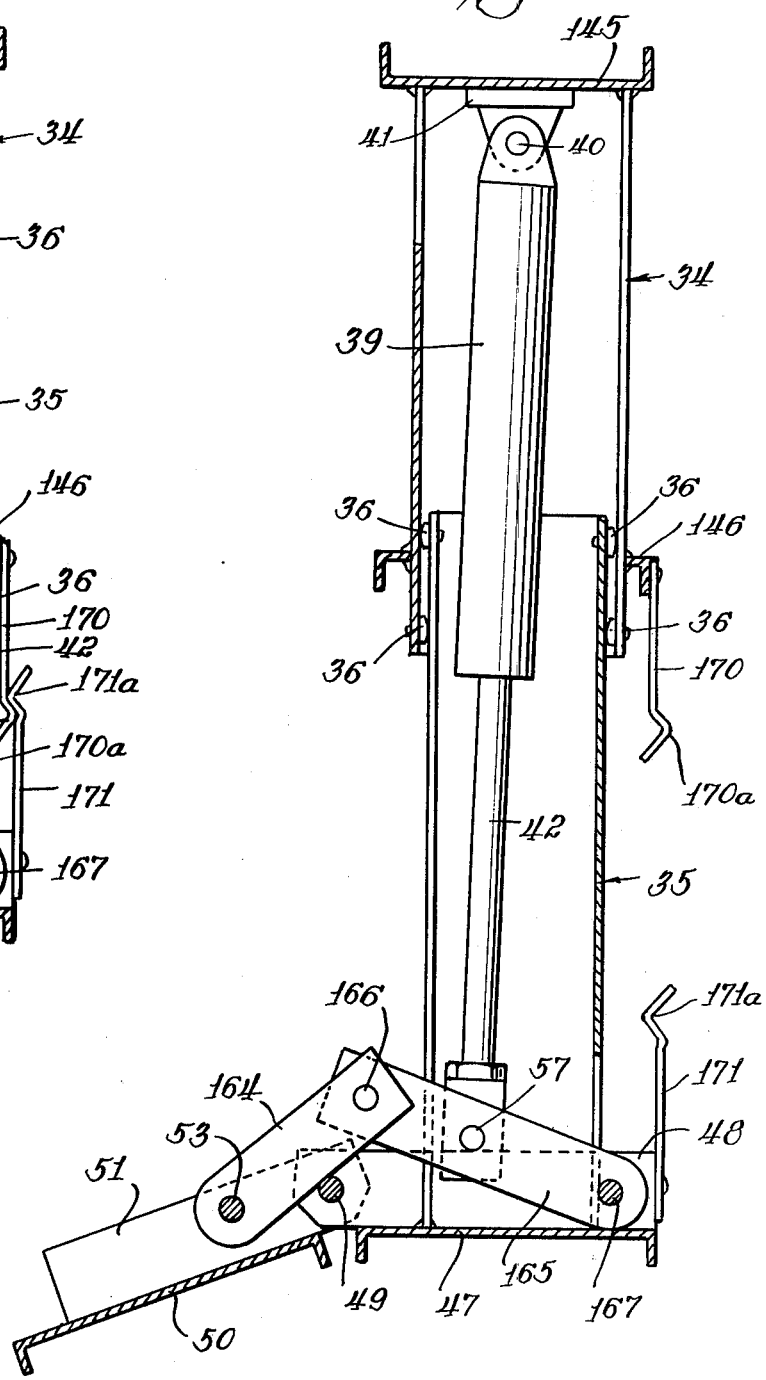
FIG. 13 is a view corresponding to FIG. 7 but showing the mechanism of FIG. 12.
Figure 11:
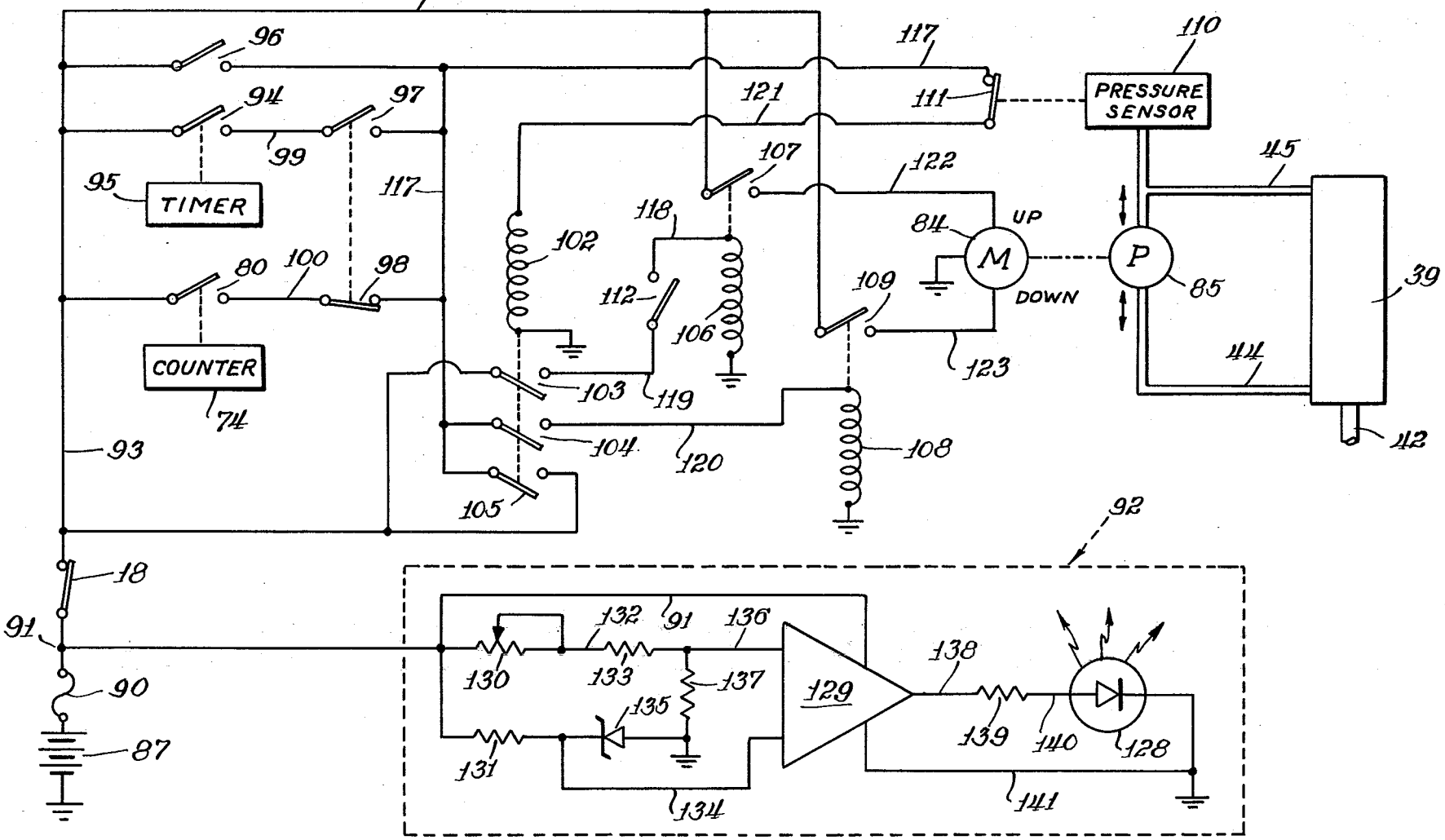

ACTUATING EMBODIMENT OF FIGS. 12 and 13

In this embodiment the tracks are omitted from the carriage. There are a pair of links 164 and a pair of links 165, the links of each pair being on opposite sides of block 43. The pairs of links are connected by pin 166. The other end of links 164 are pivotally mounted on pin 53 and the other ends of links 165 sre pivoted on a pin 167. Pin 57 engages both links 165. As the ram 39 is lengthened, pin 57 moves downwardly (and slightly to the left, describing an arc about pin 167). This pivots the links 165 counterclockwise, causing links 164 to move to the left, until finally reaching the position illustrated in FIG. 13. Of course, upon the retraction of the piston rod 42 the reverse movement initially occurs and thereafter the carriage returns to the FIG. 12 position.

FIGS. 12 and 13 also illustrate an alternative for holding the carriage 35 in the raised position, in place of spring 37. Here there is a latch formed by two relatively rigid spring arms 170 and 171. Arm 170 is secured to the portion of the subframe defined by channel 146. Arm 171 is secured to one of bars 48 of the carriage. The distal ends of the arms have interengaging confirmations 170*a* and 171*a*, respectively. As the carriage is raised to its upper position these confirmations first cam each other apart and subsequently fit together in the manner illustrated in FIG. 12. This engagement is sufficient to prevent carriage 35 from descending merely as a result of its weight. However, when the piston rod is extended sufficient force is applied to cause the arms to disengage.

I claim:

1. A trash compactor of a size to produce a relatively small, manually transportable, bale of compacted trash and comprising a housing including a frame, said housing defining a compacting chamber, a space extending upwardly from said chamber along one side of the housing and an upper opening through which trash may be inserted into the housing to descend through said space into said chamber, and a compactor mechanism mounted within said housing and on said frame and positioned at a side of the housing in juxtaposition to said space, said mechanism including a vertically movable carriage, power means for vertically moving the carriage, a fixed platen secured to the bottom of the carriage, a movable platen articulated to the side of the carriage adjacent said space for pivotal movement from an upright position to a generally horizontal position, and actuating means connected to said movable platen for so moving said platen, said compactor being characterized by:

said power means being connected to said actuating means to initially move said movable platen upon the activation of the power means, and said actuating means providing a lost motion connection to said carriage to provide carriage movement only after pivotal movement of the movable platen, whereby said movable platen serves to sweep trash from said space during descent of the carriage.

2. A compactor as set forth in claim 1, wherein said movable platen moves through and beyond a horizontal position before said carriage commences significant downward movement, whereby the movable platen acts to move trash in the part of the chamber below said space toward the opposite side of the chamber.

3. A compactor as set forth in claim 2, including gate means in said space below said housing opening and above said chamber, said gate means being mounted for movement from a first position transverse to said space thus preventing trash from falling from said opening to said chamber and a second position at which said space is relatively unobstructed, and means connected to said gate means to position said gate means in said second position when said carriage is in the raised position and to move said gate means to said first position as said carriage is lowered.

4. A compactor as set forth in claim 3, wherein said housing includes a door in said opening, said door being normally in a closed position and being manually movable to an open position for the insertion of trash; and including control means connected to said power means and responsive to the movement of said door for cycling said power means for the lowering and raising of the platen means.

5. A compactor as set forth in claim 4, including control means connected to said power means for cycling said power means, at predetermined intervals of time, for the lowering and raising of the platen means.

6. A compactor as set forth in claim 1, including means pivotally connecting said movable platen to said carriage for movement about a generally horizontal axis with respect to the carriage; and wherein the actuating means comprises a lever having two ends, one of said lever ends being pivotally attached to said movable platen at a location spaced away from said axis toward the distal side of said movable platen, and means connecting said lever to said ram for applying a force to said lever about said axis as said ram is extended and retracted.

7. A compactor as set forth in claim 6, wherein said actuating means includes track means secured to said carriage and having two ends, one end of said track means being at a greater elevation than the other end thereof, and means connecting the other end of said lever to the downward end of the ram and the two for movement along said track means.

8. A compactor as set forth in claim 7, wherein said device includes a pair of parallel, generally vertical tracks secured to said carriage, one of said tracks being farther from said axis than is the other of said tracks, a traveler mounted for movement in said one track, a second link having two ends with one pivotally connected to said traveler, and a second traveler pivotally connected to both said links and movable in said other track.

9. A compactor as set forth in claim 7, wherein said track means includes a pair of parallel tracks positioned at opposite sides of said downward end of the ram, said tracks being angled so that said one end thereof is in a vertical plane spaced a greater distance from said axis than is a vertical plane within which is located the other end of the tracks; and wherein said means connecting the other end of the lever comprises a traveller movable in said tracks.

10. A compactor as set forth in claim 6, including means connecting said carriage and said frame when said carriage is in the upper position for normally holding the carriage in that position while permitting said carriage to descend when said ram is extended and thus applying a downward force to the carriage.

11. A compactor as set forth in claim 1, including gate means in said space below said housing opening and above said chamber, said gate means being mounted for movement from a first position transverse to said space thus preventing trash from falling from said opening to said chamber and a second position at which said space is relatively unobstructed, and means connected to said gate means to position said gate means in said second position when said carriage is in the raised position and to move said gate means to said first position as said carriage is lowered.

12. A compactor as set forth in claim 11, wherein said gate has a side pivotally connected to said frame for movement between a relatively vertical position which is said second position and a generally horizontal position which is said first position, and wherein the last mentioned means includes a flexible tension member connected to be drawn downwardly as said carriage moves downwardly.

13. A compactor as set forth in claim 1, wherein said housing includes a door in said opening, said door being normally in a closed position and being manually movable to an open position for the insertion of trash; and including control means connected to said power means and responsive to the movement of said door for cycling said power means for the raising and lowering of the carriage.

14. A compactor as set forth in claim 13, wherein said control means cycles said power means only after said door has been moved between the door positions a given, plural number of times.

15. A compactor as set forth in claim 14, wherein said control means includes a mechanical counter having an input shaft, means connected to said shaft and to said door to rotate said shaft upon each movement of the door between said positions, said counter totalizer display means for exhibiting the number of times said shaft has been so rotated, and switch means actuated in response to a given number of counts of said counter for cycling said power means.

16. A compactor as set forth in claim 15, including a timer for periodically cycling said power means; and wherein said control means includes switch means connecting said timer, said switch means and said power means to alternatively render said switch means and timer ineffective for cycling said power means.

17. A trash compactor of a size to produce a relatively small, manually transportable, bale of compacted trash and comprising a frame including a housing having an upper opening through which trash to be compacted can be inserted into said housing, defining a chamber within said housing to receive said trash and within which the trash is compacted, generally vertical space extending from said opening to said chamber through which space rubbish can descend from said opening to said chamber, and a wall at the bottom of said chamber against which the trash is compacted, platen means in said chamber, and support means interconnecting the platen and the frame for aligning the platen means for movement along a generally vertical path through said chamber, said support means including power means for normally positioning said platen means in a top position at the top of said chamber and for moving said platen means toward said wall when trash in the chamber is to be compacted, said support means being positioned in said housing in a portion thereof to one side of said space, said platen means including a generally horizontal member in the part of said chamber below said portion of the housing; said compactor being characterized by:

gate means in said space below said housing opening and above said chamber, said gate means being mounted for movement from a first position transverse to said space thus preventing trash from falling from said opening to said chamber and a second position at which said space is relatively unobstructed, and means connected to said gate means to position said gate means in said second position when said platen means is in the raised position and to move said gate means to said first position as said platen means is lowered; and including means connected to said power means to move rubbish from the part of the chamber below said space toward said first mentioned part of said chamber.

* * * * *